US011168590B2

(12) United States Patent
Heym et al.

(10) Patent No.: US 11,168,590 B2
(45) Date of Patent: Nov. 9, 2021

(54) SLEEVE FOR CAM PHASER AND CAM PHASER

(71) Applicant: ECO Holding 1 GmbH, Marktheidenfeld (DE)

(72) Inventors: Rene Heym, Ostfildern / Ruit (DE); Norbert Loesch, Kirchheim (DE); Daniel Viertler, Bad Urach (DE)

(73) Assignee: ECO Holding 1 GmbH, Marktheidenfeld (DE)

( * ) Notice: Subject to any disclaimer, the term of this patent is extended or adjusted under 35 U.S.C. 154(b) by 154 days.

(21) Appl. No.: 16/681,153

(22) Filed: Nov. 12, 2019

(65) Prior Publication Data

US 2020/0224562 A1 Jul. 16, 2020

(30) Foreign Application Priority Data

Jan. 15, 2019 (DE) ..... 102019100949.9

(51) Int. Cl.
*F01L 1/344* (2006.01)

(52) U.S. Cl.
CPC ..... *F01L 1/3442* (2013.01)

(58) Field of Classification Search
CPC ..... F01L 1/3442; F01L 2001/34433; F01L 2001/34469; F01L 2001/34426; F01L 2001/34423; F01L 2001/3443
USPC ..... 123/90.17
See application file for complete search history.

(56) References Cited

U.S. PATENT DOCUMENTS

2012/0097122 A1* 4/2012 Lichti ..... F01L 1/3442 123/90.15
2012/0255509 A1* 10/2012 Lichti ..... F01L 1/3442 123/90.15
2017/0122138 A1* 5/2017 Noguchi ..... F01L 1/047
2017/0130621 A1* 5/2017 Suganuma ..... F02D 13/0219
2018/0058272 A1* 3/2018 Haltiner, Jr. ..... F01L 1/3442
2018/0274398 A1* 9/2018 Yamakawa ..... F01L 1/3442
2020/0072093 A1* 3/2020 Weber ..... F01L 1/3442

FOREIGN PATENT DOCUMENTS

DE 102015200538 A1 7/2016

* cited by examiner

*Primary Examiner* — Devon C Kramer
*Assistant Examiner* — Kelsey L Stanek
(74) *Attorney, Agent, or Firm* — Von Rohrscheidt Patents

(57) ABSTRACT

A sleeve for a cam phaser, wherein the sleeve is arranged between a central valve and a rotor of the cam phaser, wherein the rotor is rotatable relative to a stator of the cam phaser about a rotation axis of the rotor, wherein a vane of the rotor is arranged positionable between two bars of the stator, wherein the vane divides an intermediary space that is formed between the two bars into a first pressure chamber and a second pressure chamber, wherein the rotor is movable by pressures that are provided in the first pressure chamber and in the second pressure chamber, wherein the central valve is configured to provide pressure loading and pressure relief of the first pressure chamber and the second pressure chamber.

22 Claims, 9 Drawing Sheets

SLEEVE FOR CAM PHASER AND CAM PHASER

RELATED APPLICATIONS

This application claims priority from and incorporates by reference German patent application DE 10 2019 100 949.9, filed on Jan. 15, 2019.

FIELD OF THE INVENTION

The invention relates to a sleeve for a cam phaser. The invention furthermore relates to a cam phaser.

BACKGROUND OF THE INVENTION

Cam phasers for internal combustion engines are well known in the art. A typical cam phaser is characterized by a rotor and a stator that are arranged coaxial relative to each other, wherein the rotor is rotatable relative to the stator about a rotation axis. The rotor has vanes that extend in an intermediary space that is configured between two bars of the stator, wherein the intermediary space is divided into two pressure chambers. A hydraulic valve, a so called central valve is received in the rotor which can introduce and drain hydraulic fluid into the pressure chambers in a controlled manner. Thus, the central valve includes radial recesses that are axially offset from each other that are arranged opposite to hub bore holes that are configured in a rotor hub of the rotor and axially offset from each other as well wherein the radial recesses are flowable by the hub bore holes. In order to provide an effective through flow the radial recesses have to be sealed relative to each other in order to be able to provide a quick adjustment of the rotor and thus of the cam shaft. This sealing is provided by a sleeve that is arranged between the rotor and the central valve.

DE 10 2015 200 538 A1 discloses a cam phaser that includes a sleeve that is connected with the rotor in a form locking manner. The sleeve includes a stop which is configured to provide the form locking connection of the sleeve with the rotor. The sleeve extends axially exclusively over a portion of the connections which facilitate a fluid transition between the connections.

BRIEF SUMMARY OF THE INVENTION

Thus, it in an object of the instant invention to provide a sleeve for a cam phaser that already provides a secured positioning during assembly and in particular during operations of the cam phaser in order to provide secure sealing. It is another object of the invention to provide a cam phaser that provides a reliable and quick adjustment of the cam shaft.

The object is achieved by a sleeve for a cam phaser, wherein the sleeve is arranged between a central valve and a rotor of the cam phaser, wherein the rotor is rotatable relative to a stator of the cam phaser about a rotation axis of the rotor, wherein a vane of the rotor is arranged positionable between two bars of the stator, wherein the vane divides an intermediary space that is formed between the two bars into a first pressure chamber and a second pressure chamber, wherein the rotor is movable by pressures that are provided in the first pressure chamber and in the second pressure chamber, wherein the central valve is configured to provide pressure loading and pressure relief of the first pressure chamber and the second pressure chamber and includes a first operating connection that is flow connected with the first pressure chamber and a second operating connection that is flow connected with the second pressure chamber and a supply channel configured to supply hydraulic fluid wherein the supply channel is open towards the rotor, wherein the sleeve provides fluid separation of the supply channel and of the first operating connection and the second operating connection, wherein the sleeve is configured flowable and so that form locking is formable between the sleeve and the rotor, wherein a first safety element is arranged at an outer enveloping surface of the sleeve and provides secure positioning of the sleeve in the rotor by form locking in a circumferential direction, and wherein a second safety element is arranged at the sleeve and provides form locking in a direction of the rotation axis wherein the sleeve extends in the direction of the rotation axis at least over the first operating connection and the second operating connection.

Another object is achieved by a cam phaser, comprising: a rotor; a stator, wherein the rotor is rotatable relative to a stator about a rotation axis of the rotor, wherein a vane of the rotor is arranged positionable between two bars of the stator, wherein the vane divides an intermediary space that is formed between the two bars into a first pressure chamber and a second pressure chamber, wherein the rotor is movable by pressures that are provided in the first pressure chamber and in the second pressure chamber, wherein a central valve is configured to provide pressure loading and pressure relief of the first pressure chamber and the second pressure chamber and includes a first operating connection that is flow connected with the first pressure chamber and a second operating connection that is flow connected with the second pressure chamber and a supply channel configured to supply hydraulic fluid wherein the supply channel is open towards the rotor, wherein a sleeve is arranged between the central valve and the rotor and provides fluid separation of the supply channel and of the two operating connections and is partially flowable so that the pressure cavities are supplyable with fluid, and wherein the sleeve is form locked with the rotor and clamped in a radially outward direction against the rotor.

Advantageous embodiments with useful and non-trivial improvements of the invention are specified in the respective dependent claims.

A sleeve for a cam phaser according to the invention is arranged between a central valve and a rotor of the cam phaser wherein the rotor is rotatable relative to a stator of the cam phaser about a rotation axis of the rotor. A vane of the rotor is arranged positionable between two bars of the stator, wherein the vane divides an intermediary space that is formed between the two bars into a first pressure chamber and a second pressure chamber and wherein the rotor is movable by pressures that are provided in the pressure chambers.

The central valve is configured to provide pressure loading and pressure relief of the pressure chambers and includes operating connections that are flow connected with the pressure chambers and a supply channel to supply hydraulic fluid. The supply channel is open towards the rotor. The sleeve provides a fluid separation of the supply channel and of the operating connections. The sleeve is configured so that it is flowable and form locking is achievable between the sleeve and the rotor. According to the invention a first safety element is provided for safe positioning of the sleeve in the rotor at an enveloping surface of the sleeve in order to provide form locking in a circumferential direction and a second safety element is configured at the sleeve for providing form locking in a direction of the rotation axis wherein the sleeve extends in the axial direction at least over the operating connections. Thus, the sleeve is advantageously secured against a rotation relative to the rotor as well as against an axial displacement relative to the rotor and provides reliable sealing for fluid separation due to its axial extension at least over the operating connections. Advantageously the sleeve can be inserted into the rotor without tension and still has a secured position which is maintained in particular during assembly.

The sleeve furthermore facilitates a channel cross over without impacting the load path. The sleeve facilitates the connection sequence A-P-B or B-P-A, this means a radial P supply of the central valve 24.

In one embodiment of the sleeve according to the invention the safety elements are configured bar shaped and extend from an enveloping surface that is oriented towards the rotor in a direction towards the rotor. This means put differently that the safety elements extend radially outward from the enveloping surface of the sleeve. Since the safety elements are configured bar shaped grooves can be milled in a simple manner into a rotor hub of the rotor that receives the sleeve.

Advantageously the first safety element extends mostly in a direction of the rotation axis which provides a stop for preventing a rotation in a simple manner.

The second safety element extends mostly in the circumferential direction which provides a stop against axial displacement in a simple manner.

Overall the combination of the advantageous embodiments of the safety elements leads to an advantageous utilization of an inner groove that is configured in the rotor hub opposite to the central valve wherein the safety element can be configured so that they engage the inner groove so that the inner groove that is already provided can be used in a cost effective manner. This means put differently that machining the rotor is not necessary in order to reliably position the groove. The inner groove is configured opposite to the supply connection and facilitates distributing the hydraulic fluid.

In another embodiment the groove is advantageously configured to flow the operating connections and the supply connection. This means put differently that the groove extends over an entire axial length of the connections so that the groove can provide an effective and reliable seal between the connections, this means between the operating connections as well as the supply connection.

In order to reliably position the sleeve relative to the rotor the sleeve includes differently shaped flow through openings distributed over its circumference, wherein each identically shaped flow through opening is associated with a specific connection. Thus, incorrect mounting of the sleeve can be prevented, namely it can already be determined during insertion of the sleeve whether the sleeve is inserted correctly.

Advantageously the flow through openings that are associated with the supply connection are configured as a slotted hole, thus a quick exchange of hydraulic fluid can be achieved between the connections when the rotor is rotated in order to adjust the timing of the internal combustion engine since a flow through surface of the flow through opening can be configured larger than e.g. a circular flow through opening so that sufficient hydraulic fluid can flow through the flow through opening.

A quick exchange of hydraulic fluid can be improved further in that the flow through openings that are associated with the supply connection are mostly arranged so that they extend in the circumferential direction wherein their extension in the circumferential direction is greater than their extension in the axial direction along the rotation axis.

An advantageous sealing between the connections can be achieved when the flow through openings that are associated with the first consumer connection and/or the second consumer connection are configured substantially circular since the corresponding hub bore holes are also configured circular.

As an alternative to a substantially circular flow through opening of the sleeve the flow through openings that are associated with the first consumer connection and/or the second consumer connection are configured groove shaped. This is advantageous in particular when the flow through opening is proximal to or at a sleeve end.

In another advantageous embodiment of the sleeve according to the invention the sleeve is oversized relative to an opposite enveloping surface of the central valve before the sleeve is mounted in the central valve. This means put differently that an interior diameter of the sleeve is smaller than an exterior diameter of the central valve. This provides an option of a sealing press fit of the sleeve with the rotor and with the central valve since an expansion of the sleeve occurs when the sleeve is pushed into the central valve which can also be considered a material displacement occurring in the sleeve. Put differently the central valve is oversized relative to the sleeve which has the same effect.

In order to provide simplified assembly and thus improved insertion of the central valve into the sleeve the sleeve includes at least one insertion element. The insertion element is advantageously configured as a bevel that is arranged at an inner surface of the sleeve at a sleeve end.

A further secured positioning of the sleeve can be achieved by clamping elements that extend in a direction of a valve axis of the central valve.

In another embodiment of the sleeve according to the invention the sleeve includes differently sized interior diameters wherein the interior diameters are configured continuously increasing or decreasing in the axial direction of the sleeve. This means put differently that the inner diameters are configured either increasing or decreasing in the axial direction. This way the central valve can be inserted into the sleeve and a slow but continuous displacement of the sleeve in a direction towards the rotor can be implemented in particular when the inner diameter is configured decreasing in an insertion direction of the central valve which helps to prevent damaging the sleeve.

Additional sealing between the central valve and the sleeve can be achieved by an inner surface of the sleeve that is oriented towards the central valve and that is configured convex at least in sections.

In an advantageous embodiment of the sleeve according to the invention the sleeve is produced by injection molding. The injection molding can be a plastic injection molding method or a powder injection molding method. The powder injection molding method provides the option to form the sleeve from a synthetic material including metal particles which achieves an advantageous strength combined with elasticity due to the synthetic material.

The sleeve itself can also be produced using another method wherein synthetic material is particularly suitable since this makes the sleeve light and elastic. The elasticity helps to achieve an advantageous clamping of the sleeve between the rotor and the central valve which helps to achieve excellent sealing between the individual connections. Thus, using additional seal elements becomes superfluous. Another advantage over a sleeve that is completely made from metal lies in the fact that the metal sleeve typically has to be produced with precise tolerances and thus expensively so that leakages can be prevented through the precise tolerances.

A second aspect of the invention relates to a cam phaser including a rotor and a stator wherein the rotor is rotatable relative to the stator about a rotation axis of the rotor. A vane of the rotor is arranged positionable between two bars of the stator, wherein the vane divides an intermediary space that is formed between the two bars into a first pressure chamber and a second pressure chamber and wherein the rotor is movable by pressures that are provided in the pressure chambers. A central valve is configured to provide pressure loading and pressure relief of the pressure chambers and includes operating connections that are flow connected with the pressure chambers and a supply channel to supply hydraulic fluid wherein the supply channel is open towards the rotor. A sleeve that is arranged between the central valve and the rotor provides fluid separation of the supply channel and of the operating connections and is partially flowable to supply the pressure chambers.

According to the invention the sleeve is configured form locking with the rotor and clamped radially outward against the rotor. The advantage is reliable sealing between the connections which facilitates reliable and quick rotation of the cam shaft in order to adjust gas control valve timing of the internal combustion engine.

In an embodiment of the cam phaser according to the invention a complete clamping of the sleeve is provided in an end position of the central valve. This means put differently that the clamping of the sleeve is not already provided during assembly when the sleeve could be damaged but the clamping is performed at an end of the assembly when the central valve assumes its end position.

In another embodiment of the cam phaser according to the invention a sleeve end that is oriented away from the central valve for adjusting the pressure unloading and the pressure loading of the actuator is configured for being clamped with the rotor using the central valve.

In another embodiment of the cam phaser according to the invention the central valve is configured convex at a housing enveloping surface that is arranged opposite to the sleeve. The advantage is an improved insertion and thus mounting of the central valve in the sleeve, on the other hand side a controlled compressing of the sleeve and thus a reliable sealing can be provided due to the convex housing enveloping surface.

Advantageously the sleeve is configured according to one of the claims 1-18. Thus, all advantages of the sleeve according to the invention can be combined with the advantages of the cam phaser according to the invention which achieves particularly quick adjustment of the cam shaft. Thus, an internal combustion engine that includes a cam shaft that is provided with the cam phaser according to the invention can be quickly operated with reduced fuel burn in optimized operating points.

BRIEF DESCRIPTION OF THE DRAWINGS

Further advantages, features and details of the invention can be derived from the subsequent description of advantageous embodiments and from the drawing figure. The features and feature combinations recited in the preceding description and recited in the subsequent figure description and/or features and feature combinations that are shown in the drawing figures are not only usable in the respectively stated combination but also in other combinations or by themselves without departing from the spirit and scope of the invention. Identical reference numerals are associated with identical or functionally equivalent elements. In order to provide clarity it is possible that the elements are not provided with reference numerals in all drawing figures without losing the association, wherein.

DETAILED DESCRIPTION OF THE INVENTION

Figure 1:
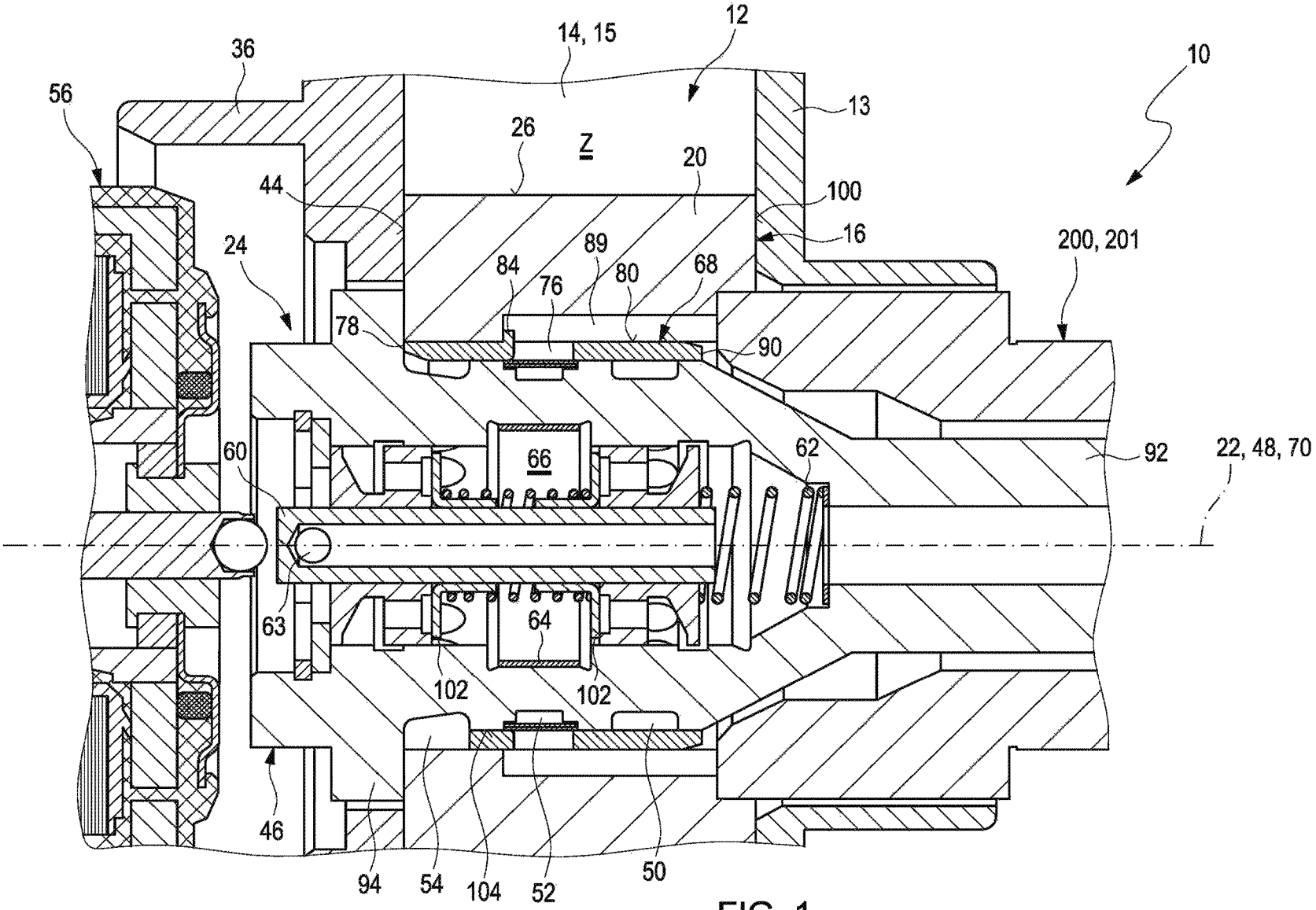
FIG. 1 illustrates a longitudinal sectional view of a detail of a cam phaser according to the invention in a first sectional plane.

A cam phaser 10 according to the invention which is illustrated in a detail sectional view in FIG. 1 is configured to adjust an angular position of a cam shaft 201 during operations of an internal combustion engine 200 including the cam shaft 201. This means put differently the cam phaser 10 facilitates to implement an adjustment of opening and closing timing of gas control valves of the internal combustion engine 200 during operations of the internal combustion engine 200.

Thus, the cam phaser 10 adjusts an angular orientation of the cam shaft 201 relative to a non-illustrated crank shaft of the internal combustion engine 200 in a continuously variable manner, wherein the cam shaft 201 is rotated relative to the crank shaft. Rotating the cam shaft 201 moves the opening and closing timing of the gas control valves so that the internal combustion engine 200 can develop optimum power at a specific speed.

The cam phaser 10 includes a cylindrical stator 12 that is connected torque proof with a drive wheel 13 that is rotatably arranged on the cam shaft 201. The drive wheel 13 is configured as a sprocket over which a chain is run that is not illustrated in more detail. By the same token the drive wheel 13 can also be a timing belt cog over which a drive belt is run that forms a drive element. The stator 12 is operatively connected with the crank shaft through the drive element and the drive wheel 13.

The stator 12 includes a cylindrical stator base element 14 including radially inward extending bars 15 at an inside of the stator base element that are arranged with uniform intervals there between so that an intermediary space Z is formed between two respective adjacent bars 15. A pressure medium, typically a hydraulic fluid is introduced into the intermediary space Z in a controlled manner by a hydraulic valve 24 in the instant embodiment by a central valve. The stator 12 is configured including a rotatable rotor 16 of the cam phaser 10.

Figure 2:
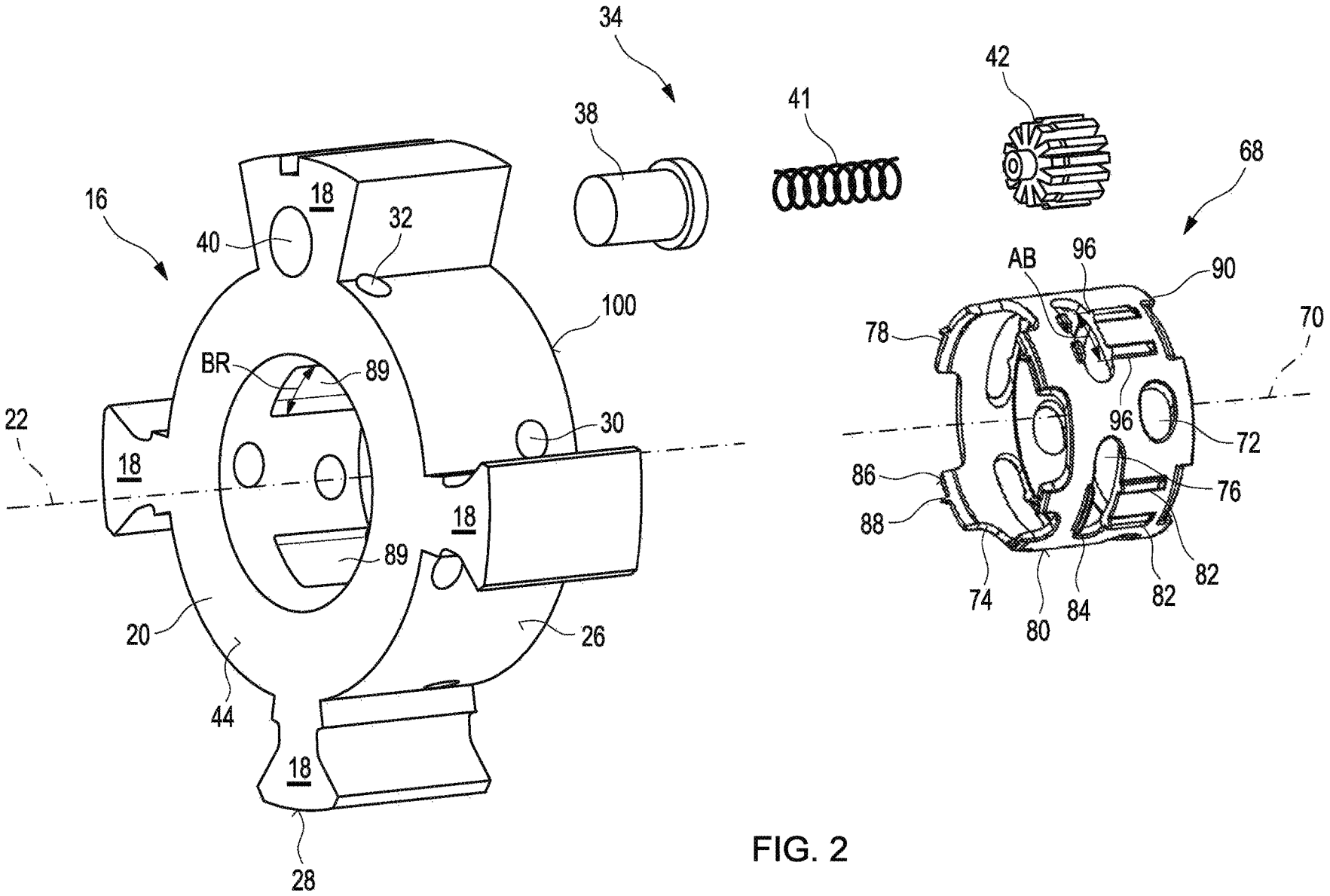
FIG. 2 illustrates an exploded view of a rotor with a sleeve according to the invention for the cam phaser according to FIG. 1.

A respective vane 18 of the rotor 16 is positioned so that it protrudes into the intermediary space Z wherein the rotor is arranged at a rotor hub 20 of the rotor 16 as evident in particular from FIG. 2 of the cam phaser 10 according to the invention. The rotor hub 20 includes a plurality of vanes 18 that corresponds to a number of intermediary spaces Z. The rotor 16 includes a rotation axis 22 and is rotatable about the rotation axis 22.

Thus the vanes 18 divide the intermediary spaces Z respectively into a first pressure chamber and a second pressure chamber. The first pressure chamber is flow connected with a first operating connection A of the central valve 24 and the second pressure chamber is flow connected with a second operating connection B of the central valve 24.

In order to reduce a pressure loss in the first pressure cavity and in the second pressure cavity the bars 15 are configured so that they contact an outer enveloping surface 26 of the rotor hub 20 with their inner surfaces so that a contact seal is established. Accordingly the vanes 18 are arranged with their outer surfaces 28 so they seal tight against an inside of the stator 12 that is positioned opposite to the outer enveloping surface 26 and not illustrated.

The rotor 16 is connected torque proof with the cam shaft 201 of the internal combustion engine 200. In order to adjust an angular position between the cam shaft 201 and the crank shaft the rotor 16 is rotated relative to the stator 12 about the rotation axis 22 wherein the stator 12 is arranged coaxial to the rotor 16. Thus, the pressure medium in the first pressure chamber or in the second pressure chamber is pressurized whereas the second pressure chamber or the first pressure chamber is unloaded. The unloading is performed by a tank connection T which is opened for unloading. The central valve 24 is shown in a sectional view along the valve axis 48 which is configured coaxial with the rotation axis 22 and shown in a detail of FIG. 1.

Figure 3:
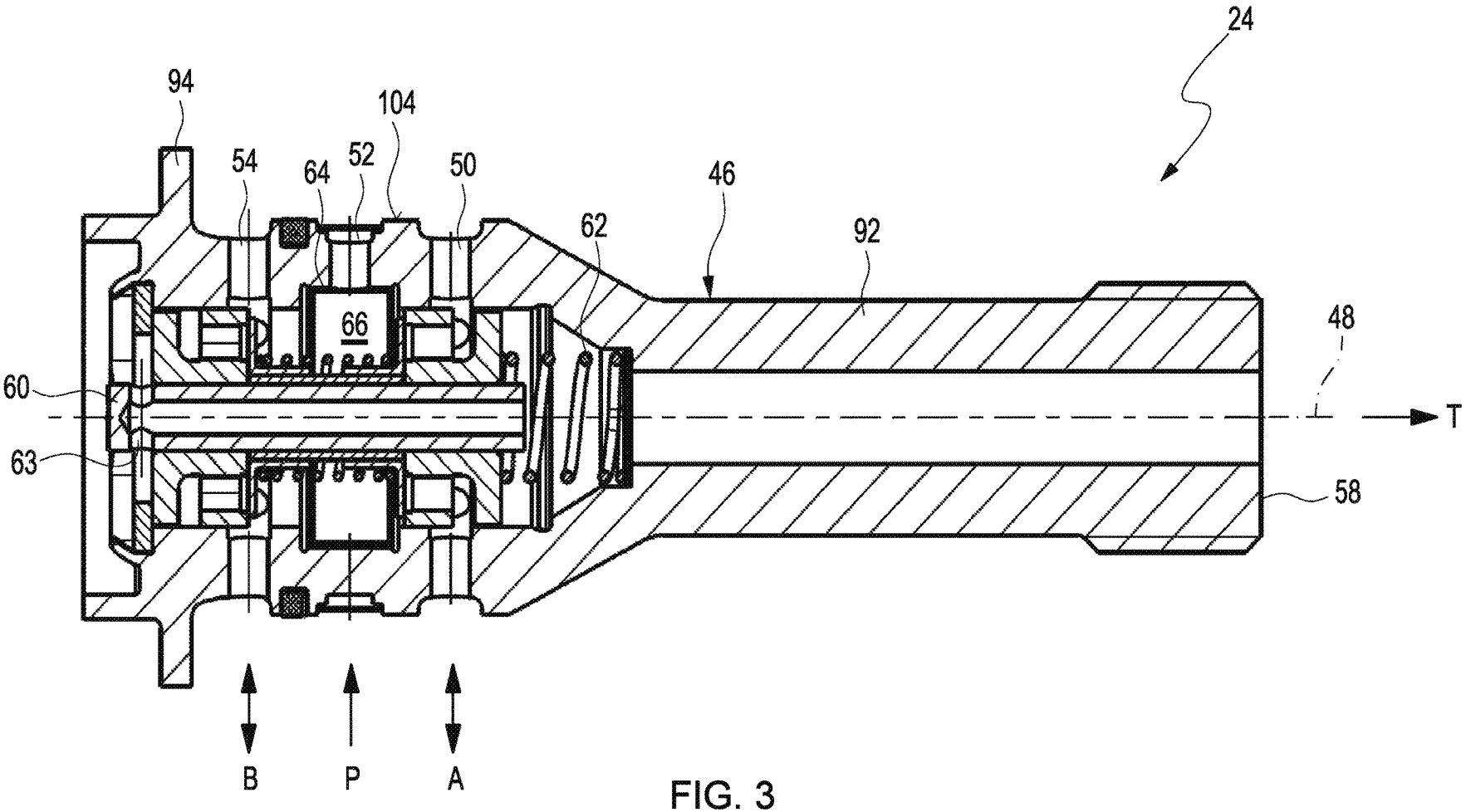
FIG. 3 illustrates a longitudinal sectional view of a central valve of the cam phaser according to the invention.

A slightly modified embodiment of the central valve 24 is illustrated in its entirety in FIG. 3. The basic configuration and the function of the illustrated central valve embodiments are identical.

In order to rotate the rotor 16 relative to the stator 12 counterclockwise the first pressure chambers are pressurized by the central valve 24 through first radial hub bore holes 30 that are spaced along a circumference of the rotor hub 20 in uniform intervals and illustrated in particular in FIG. 2. In order to rotate the rotor 16 clockwise, thus in a opposite direction relative to the stator 12 the second pressure chambers are pressurized by the central valve 24 through second radial hub bore holes 32 wherein the second hub bore holes 32 are also distributed in uniform intervals over the circumference of the rotor hub 20. The second hub bore holes 32 are offset from each other radially and axially and also along the rotor hub 20 from the first hub bore holes 30. During pressure loading the respective other pressure chamber is unloaded towards the tank connection T.

In order to lock the stator 12 at the rotor 16 a locking unit 34 is provided. The locking unit 34 includes a locking disc 36 that is arranged coaxial to the rotor 16 or the stator 12 and which can also be configured as a drive wheel and a cylindrical locking bolt 38 that is received axially movable in a locking opening 40 that is configured in one of the vanes 18 of the rotor 16. Additionally the locking unit 34 includes a coil spring 41 configured to preload the locking bolt 38 wherein the coil spring is supported at a support element 42 which is also used for closing the locking opening 40. The locking opening 40 is open at a side that is oriented towards the locking disc 36 and that is arranged at a first rotor surface 44 of the rotor 16 so that the locking bolt 38 can move into its locking position in order to lock the locking disc 36.

The central valve 24 includes a tubular housing 46 that includes radial recesses 50, 52, 54 that are offset from each other in axial direction along its valve axis 48 wherein the radial recesses form the first operating connection A, the supply connection P and the second operating connection B. The supply connection P is advantageously arranged between the two operating connections A, B. In the illustrated embodiment the tank connection P is arranged in the housing 46 at a valve face 58 that is oriented away from the actuator 56. The tank connection T, however, can also be configured as a radial connection.

A hollow piston 60 is arranged in the housing 46 and movable in a direction of the valve axis 48 relative to the housing 46 against the reset force of a reset spring 62 and that includes radial openings 63. In a first position of the hollow piston 60 that is not illustrated the first operating connection A is connected with the supply connection P and simultaneously the second operating connection B is connected with the tank connection T. In a second position of the hollow piston 60 the first operating connection A and the second operating connection B are blocked for the fluid flow. In a third position of the hollow piston 60 that is illustrated in FIG. 3, the second operating connection B is connected with the supply connection P and the first operating connection A is simultaneously connected with the tank connection T.

A check valve 64 is arranged downstream of the supply connection P. An interior space 66 is arranged downstream of the check valve 64. This interior space 66 provides a connection of the connection's A, B, P as a function of a positioning of the hollow piston 60.

In order to adjust the rotor 16 its first pressure chambers are connected through one of the two operating connections A or B with the supply connection P in the cam phaser 10 whereas the second pressure chambers of the rotor 16 are simultaneously connected through the other operating connection B or A with the tank connection T. When the rotor is adjusted a hydraulic pressure is applied to the operating connection A; B that is connected with the tank connection T. This hydraulic pressure is the greater, the faster the adjustment is performed. Additional check valves 102 are opened when the pressure exceeds a threshold value and thus facilitates using the pressure spikes in that hydraulic fluid is conducted from the operating connection A; B that is connected with the tank connection T through the opening check valve 102 through the space 66 into the operating connection A, B that is connected with the supply connection P. Thus the central valve 24 facilitates a quicker adjustment together with a lower loading of a hydraulic pump that is associated with the cam phaser 10 and not illustrated in more detail.

Figure 4:
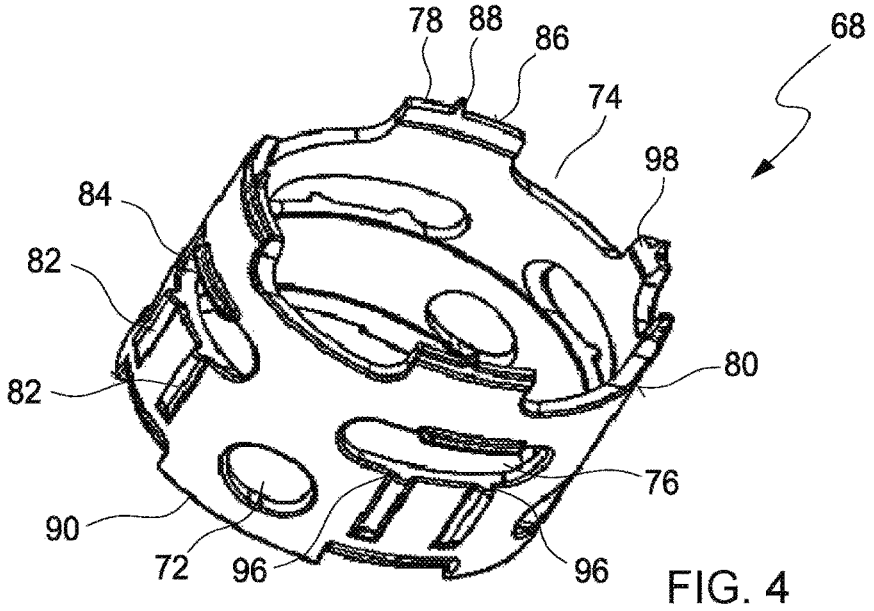
FIG. 4 illustrates a first perspective view of the sleeve according to the invention.
Figure 5:
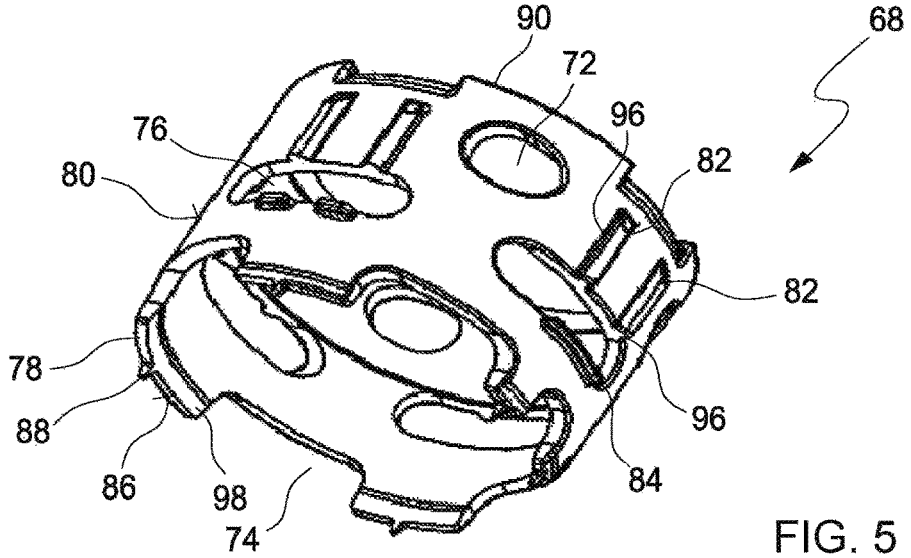
FIG. 5 illustrates a second perspective view of the sleeve according to FIG. 4.
Figure 6:
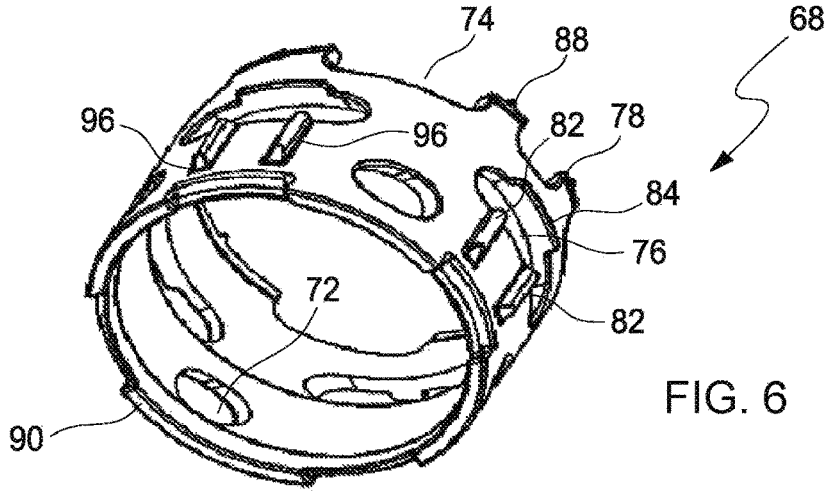
FIG. 6 illustrates a third perspective view of the sleeve according to FIG. 4.
Figure 7:
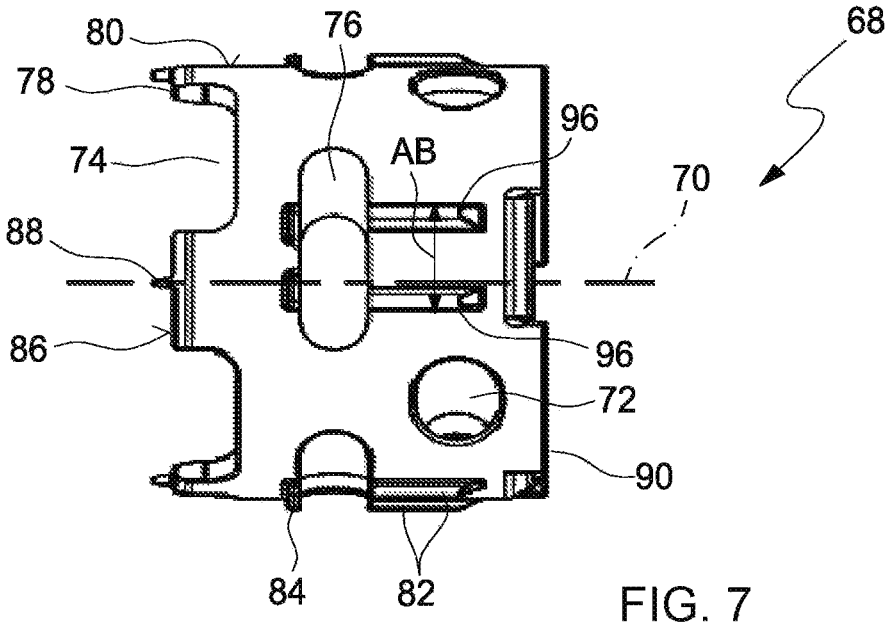
FIG. 7 illustrates a side view of the sleeve according to FIG. 4.
Figure 8:
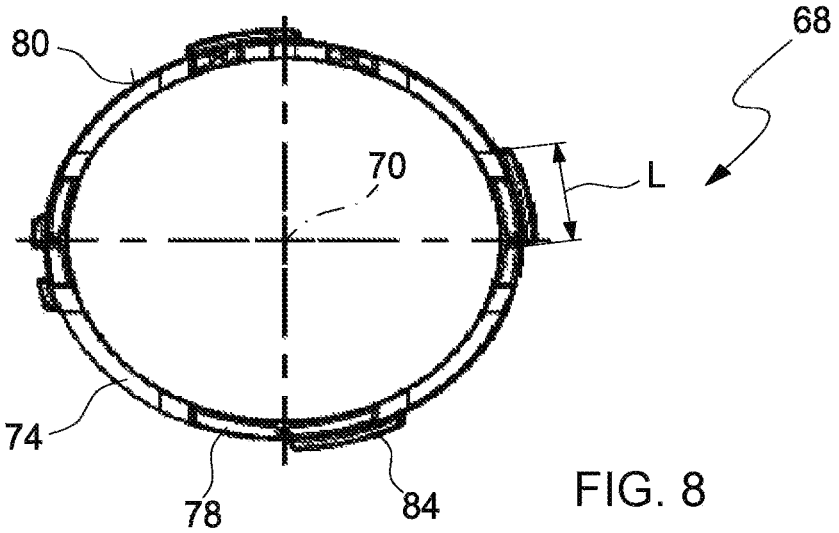
FIG. 8 illustrates a front view of the sleeve according to FIG. 4.
Figure 9:
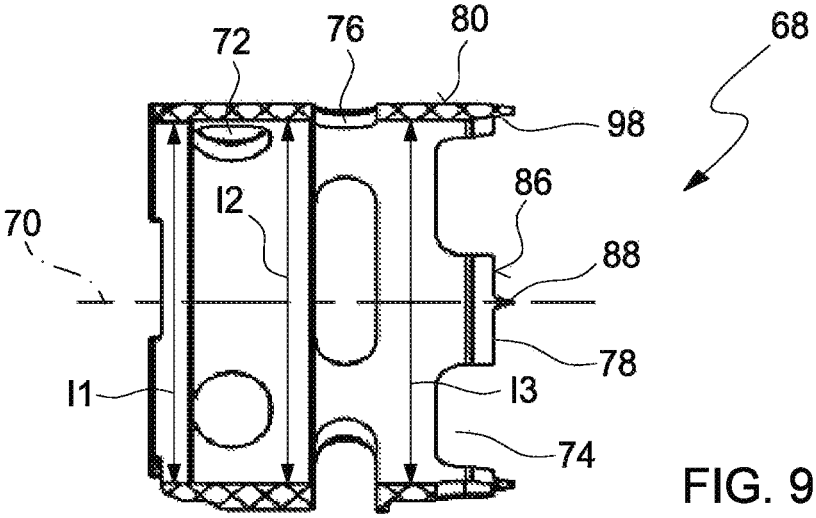
FIG. 9 illustrates a longitudinal sectional view of the sleeve according to FIG. 4.
Figure 10A:
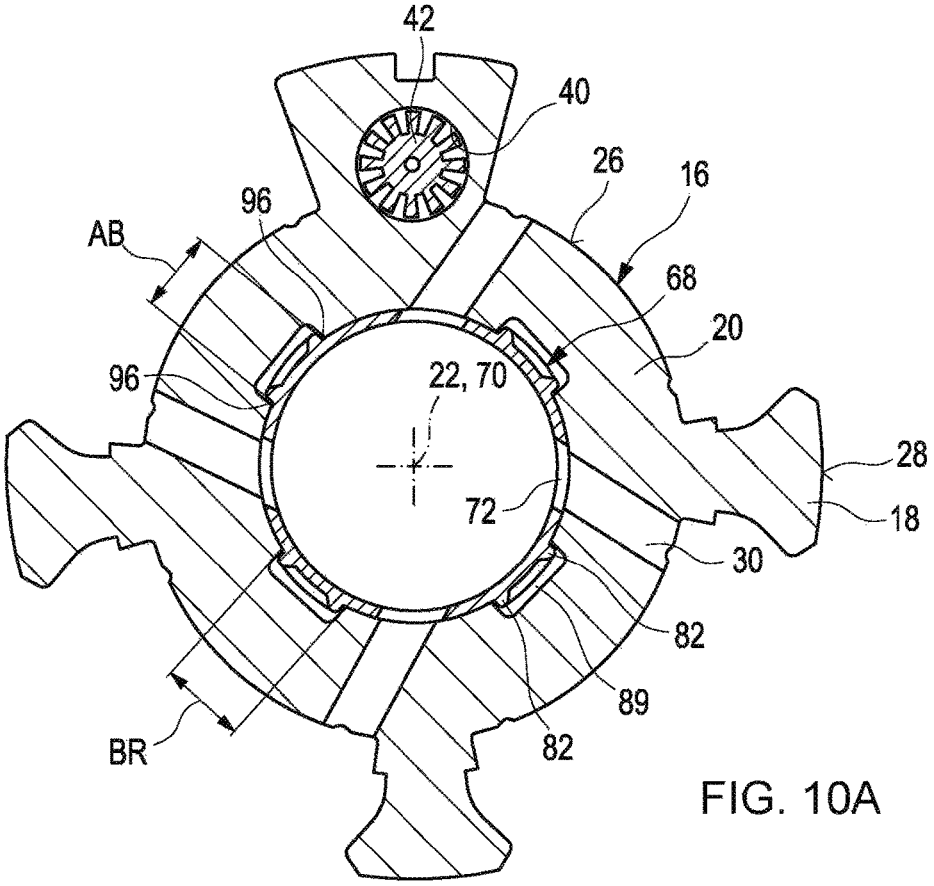
FIG. 10A illustrates a sectional view along a sectional plane through a rotor including first flow through opening associated with a first operating connection including the sleeve according to the invention.
Figure 10B:
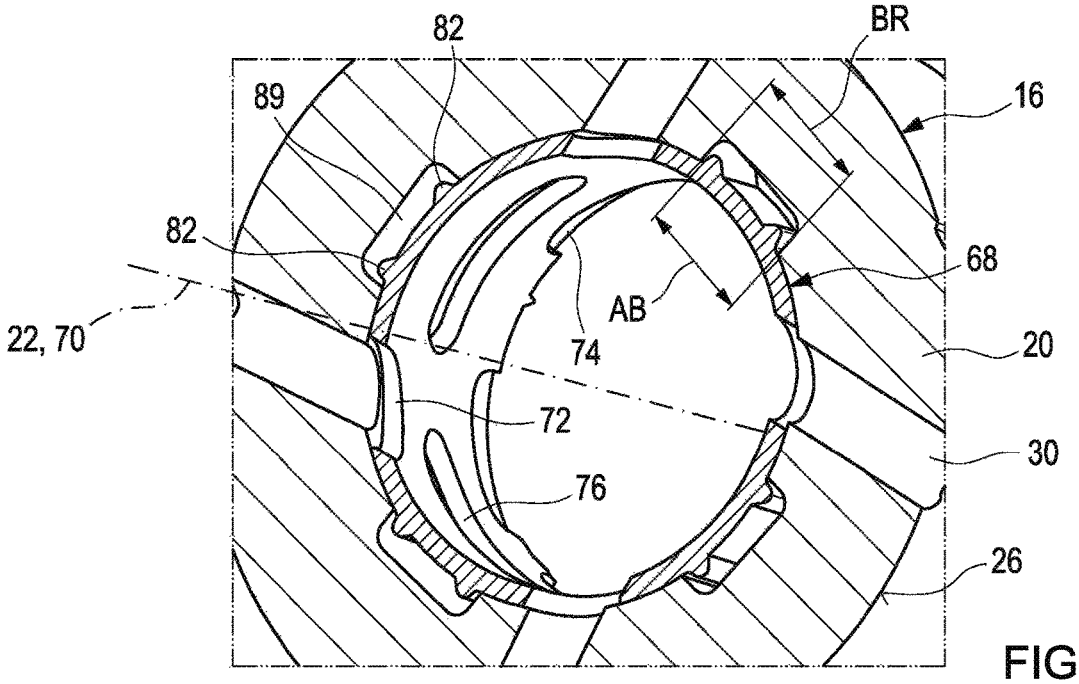
FIG. 10B illustrates a perspective detail view of the rotor according to FIG. 10A.
Figure 11A:
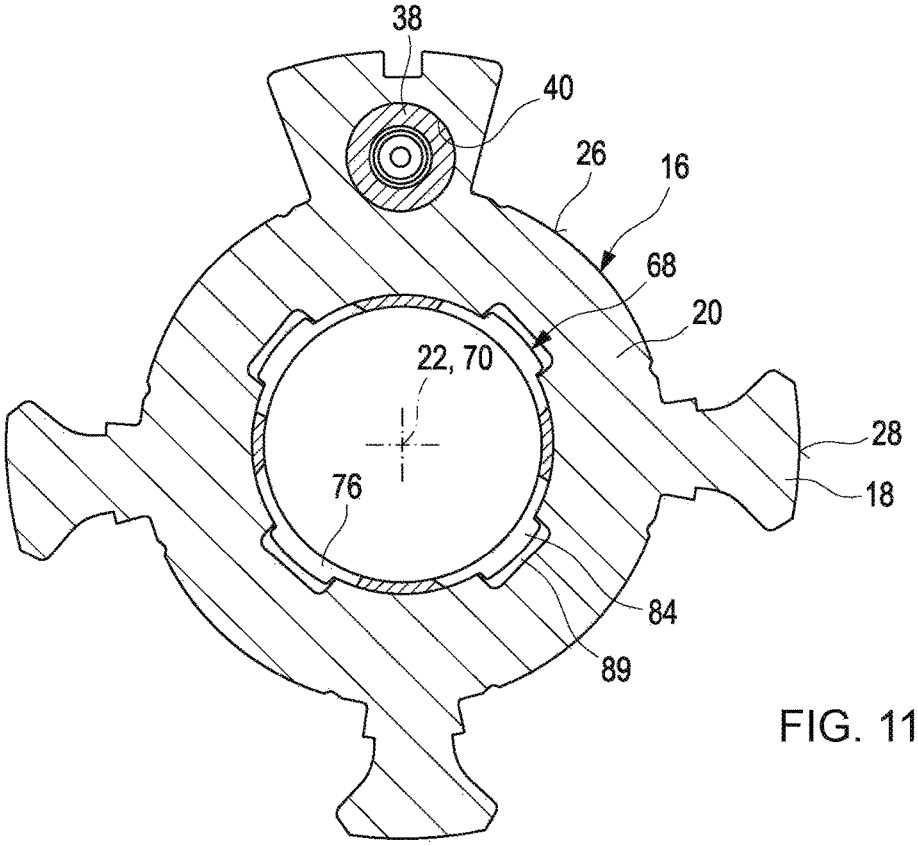
FIG. 11A illustrates sectional view along a sectional plane through third flow through openings associated with the supply connection P wherein the rotor includes the sleeve according to the invention.
Figure 11B:
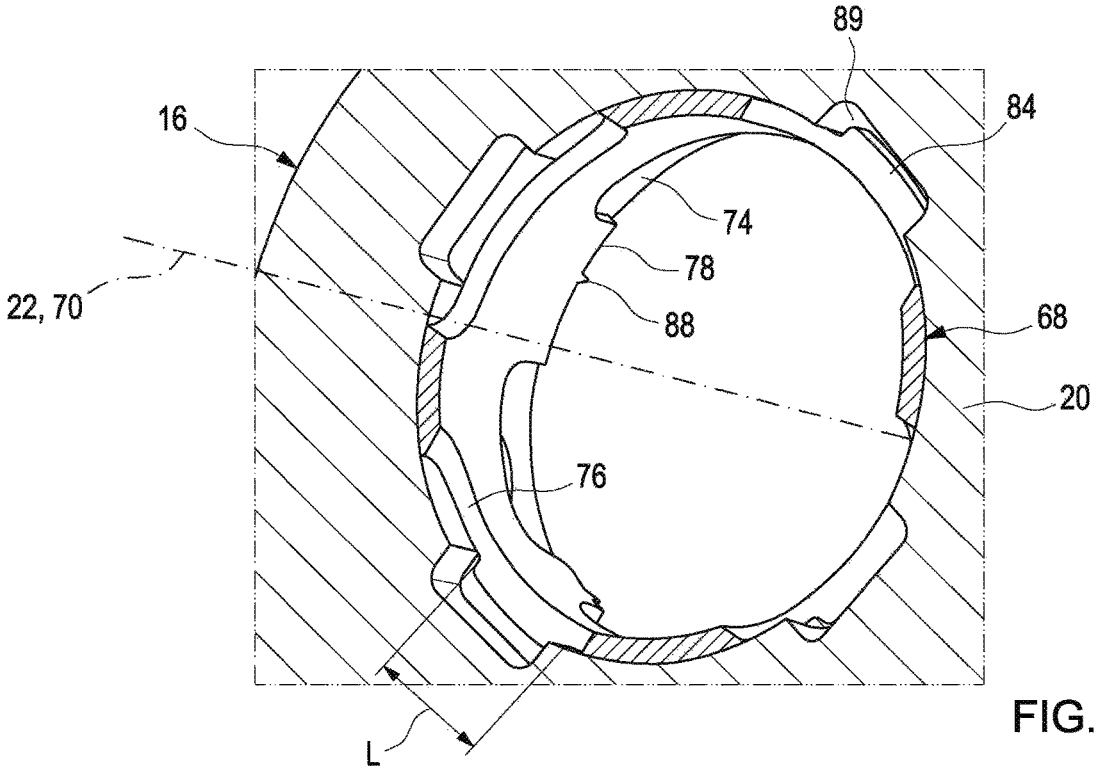
FIG. 11B illustrates a perspective detail view of the rotor according to FIG. 11A.
Figure 12A:
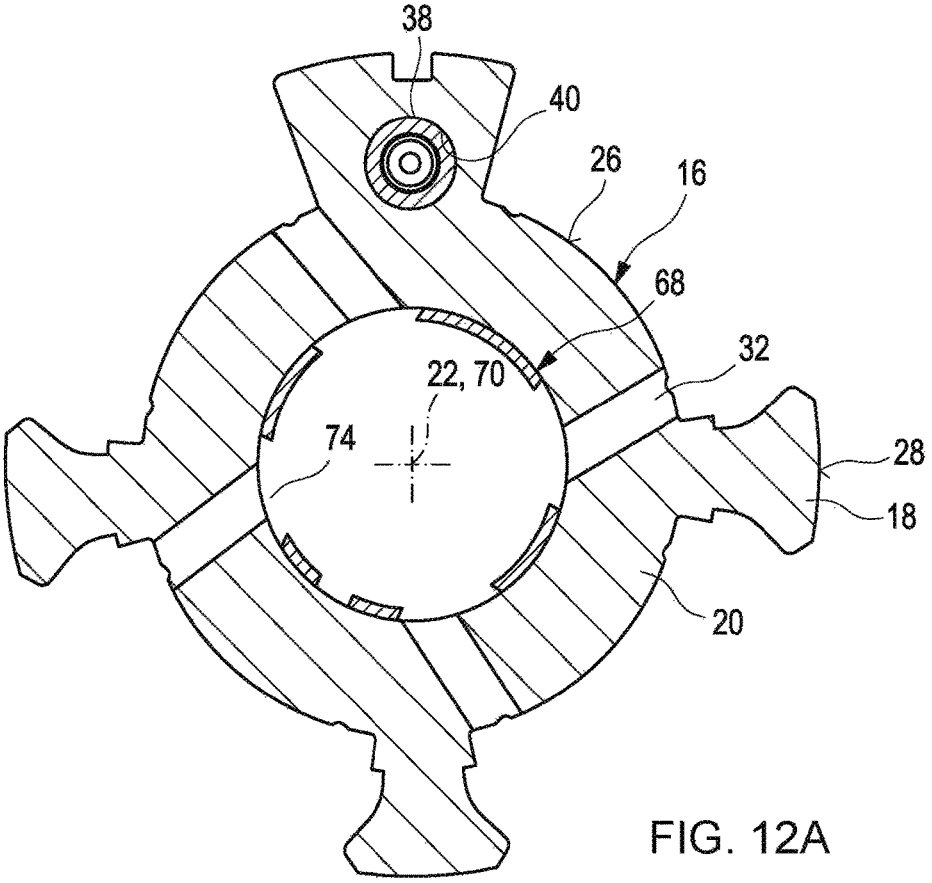
FIG. 12A illustrates a sectional view along a sectional plane through second flow through openings associated with a second operating connection wherein the rotor includes the sleeve according to the invention.
Figure 12B:
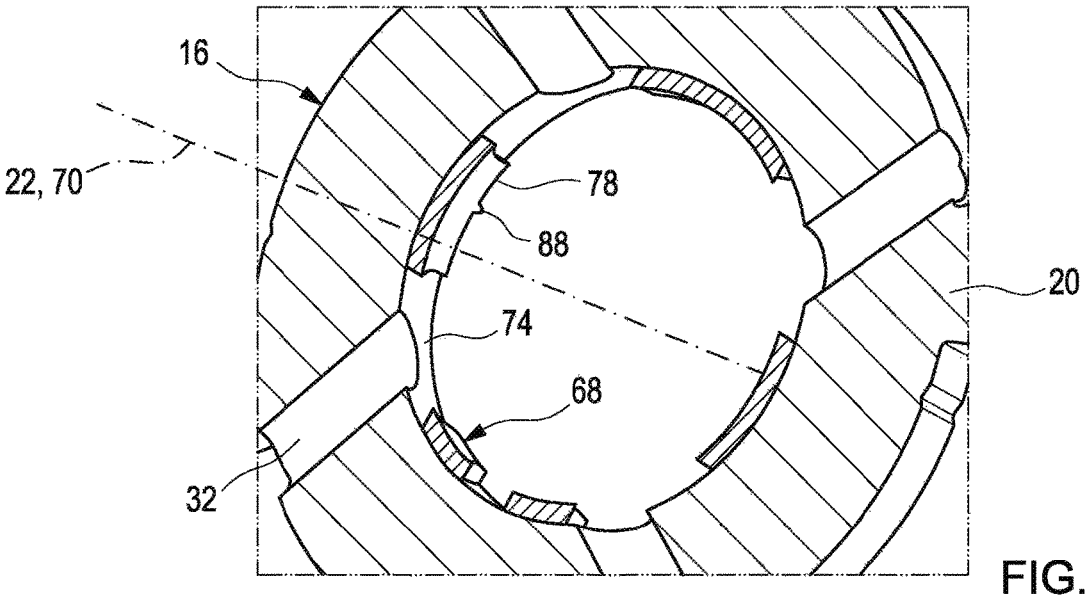
FIG. 12B illustrates a perspective detail view of the rotor according to FIG. 12A.

In order to conduct hydraulic fluid and separate the fluid between the connections A, B, P a sleeve 68 is provided between the rotor 16 and the central valve 24. The sleeve 68 is configured flowable in the radial direction and includes a sleeve axis 70 that is configured coaxial with the rotation axis 22. The sleeve 68 is illustrated in various perspective views in FIGS. 4-6 and in a side view, a front view and in a longitudinal sectional view in FIGS. 7-9.

The sleeve 68 that is essentially formed hollow cylindrical includes flow through openings in order to provide flow through the operating connections A, B and the supply connection P, wherein the first flow through opening 72 is configured to provide flow through the first operating connection A, second flow through openings 74 are configured to provide a flow through the second operating connection B and third flow through openings 76 are configured to provide flow through the supply connection P.

The flow through openings 72, 74, 76 are configured distributed over a circumference of the sleeve 68 and shaped differently for each connection A; B; P, wherein each identically formed flow through opening 72; 74; 76 is associated with a specific connection A; B; P.

The first flow through openings 72 which are associated with the first operating connection A essentially have a round circumference. Essentially means in this context that the circumference does not have to be circular, but can also be oval, elliptical or can be configured as a short slotted hole. Their essentially circular circumference is adapted to the first hub bore holes 30, wherein the first flow through openings 72 have at least a circumference of the first hub bore holes 30 but can also be slightly larger which is implemented in the instant embodiment.

The second flow through openings 74 which are associated with the second operating connection B or the second hub bore holes 32 are configured groove shaped. This means put differently that they are only partially defined by material along their circumference. This has e.g. the advantage that the material can be saved which reduces cost in that at least a wall that defines the second flow through opening 74 is omitted. By the same token the axial installation space of the central valve 24 can be limited to a minimum and the arrangement of the sleeve 68 does not require any additional installation space.

The third flow through openings 76 are arranged in the axial direction between the first flow through openings 72 and the second flow through openings 74 and facilitate a flow through the supply connection P. The third flow through openings 76 are shaped as slotted holes and substantially extend in the circumferential direction wherein their extension in the circumferential direction is greater than their extension in the axial direction along the sleeve axis 70.

Circumferences of the flow through openings 72; 74; 76 are respectively provided with a small oversize relative to circumferences of the radial recesses 50, 52, 54 so that it is assured that hydraulic fluid flowing into and out of the connections A, B, P can flow completely and unrestricted into the respective connections A, B, P in particular for quick adjustment. This can be derived in particular from FIGS. 10A, 10B, 11A, 11B, 12A and 12B which illustrate a sectional view of a perspective view of the respective sectional plane of the rotor 16 through the flow through openings 72, 74, 76 in combination with the hub bore holes 30, 32 and an inner groove 89 of the rotor 16 that is configured in the portion of the second radial recess 52.

Safety elements 82, 84 are arranged adjacent to the third flow through opening 76 at an enveloping surface 80 along an outer circumference of the sleeve 68 wherein the safety elements are configured to provide secure positioning of the sleeve 68 during assembly and operations of the cam phaser 10. The safety elements 82, 84 are configured to provide form locking wherein the first safety elements 82 provide form locking in the circumferential direction, thus against a rotation of the sleeve 68 and the second safety elements 84 provide a form locking in the longitudinal direction or in axial direction and thus a limitation through a contact stop.

The safety elements 82, 84 are configured bar shaped, wherein the first safety elements 82 extend substantially in the axial direction and the second safety elements 84 extend substantially in the circumferential direction. The safety elements are configured to engage the inner groove 89 that is configured in the rotor hub 20 which is provided flow connected with the supply connection P in the rotor 16. This means put differently that the existing inner groove 89 is used to provide reliable positioning of the sleeve 68. This has the advantage that no additional groove or receiving opening has to be produced for the safety elements 82, 84 in the rotor 16.

The first safety elements 82 are configured in pairs, wherein a respective pair of first safety elements 82 is arranged adjacent to a third flow through opening 76 since the first safety elements 82 that provide rotation safety are configured in pairs a sufficiently large volume of inner groove 89 that is fillable with hydraulic fluid is still provided.

The second flow through openings 74 are arranged at a first sleeve end 78 that is oriented towards the actuator 56. Clamping elements 88 are provided at a face 86 of the sleeve 68 that is configured at a first sleeve end 78 wherein the clamping elements are configured as pins in the instant embodiment.

When mounting the cam phaser 10 the sleeve 68 is secured in position by the safety elements 82, 84 and placed into the rotor 16. Thereafter the central valve 24 is inserted starting at the first sleeve end 78 and moving towards a second sleeve end 90 that is oriented away from the first sleeve end 78, wherein the central valve 24 is threaded with its boss 92 into the cam shaft 201. The central valve 24 includes an annular stop 94 at an end that is oriented away from the boss 92, wherein the annular stop provides a contact for the central valve 24 and thus a limitation of an axial insertion into the rotor 16. When a contact is formed between the rotor 16 and the stop 94 the central valve 24 is in its end position and the clamping elements 88 are deformed and compressed in this end position. This implements an additionally secured axial positioning of the central valve 24 and of the sleeve 68 relative to the rotor 16.

In order to provide secure positioning of the sleeve 68 the rotor 16 includes inner grooves 89 into which the safety elements 82, 84 are placed. A width BR of the inner groove 89 is slightly larger than a distance AB of outer edges 96 that are oriented away from each other wherein the outer edges 96 are arranged parallel to each other at first safety elements 82 that are arranged at a third flow through opening 76. A length L of the second safety element 84 that extends in the circumferential direction corresponds to the width BR which provides the advantage of an interlocking and thus of a secure form locking connection of the sleeve 68 with the rotor 16. This means put differently that the sleeve 68 is mounted in the rotor 16 by insertion from a side that is oriented away from the actuator 56 and continuing the insertion until the second safety elements 84 contact the inner groove 89 in the axial direction. Thus, the sleeve 68 is precisely positioned in the rotor 16 to mount the central valve 24 and securely retained.

The inner groove 89 extends from a second rotor surface 100 that is oriented away from the actuator 56 in the axial direction entirely over the third flow through opening 76 which defines the inner groove 89 in the radial direction or put differently covers the inner groove so it is flowable. Thus, the inner groove 89 can be advantageously introduced starting from the second rotor surface 100 into the rotor hub 20. It is appreciated that a width BR of the inner groove 89 corresponds with slight oversize to an extension of the third flow through opening 76 in the circumferential direction in order to facilitate a flow through of the third flow through opening 76.

In order to improve assembly of the central valve 24 the sleeve 68 includes at least one insertion element 98 which is configured in the instant embodiment at its face 86 as a bevel 98 that is arranged at the first sleeve end 78. The bevel improves insertion of the central valve 24 into the sleeve 68 that is arranged in the rotor 16.

The sleeve 68 includes several shoulders at an inside and has differently sized inner diameters I1, I2, I3. The inner diameters I1, I2, I3 are configured decreasing from the first sleeve end 78 in a direction towards the second sleeve end 90. Thus, the inner diameter I1 forms a smallest inner diameter of the sleeve 68. Thus, the central valve 24 can be inserted into the sleeve 68 and a slow but continuous displacement of the sleeve 68 can be performed in a direction towards the rotor 16 which prevents damaging the sleeve 68.

In order to press the sleeve 68 together with the central valve 24, the central valve 24 includes a housing enveloping surface 104 that is convex in sections. This means put differently that the housing enveloping surface is substantially rounded in sections. This is visible quite well in FIG. 13 in a longitudinal sectional view of a detail of the cam phaser 10 according to the invention as well as in FIG. 14, a partial sectional view of the cam phaser 10. Thus, housing sections that are configured between the radial recesses 50, 52, 54 are configured convex in the radial direction or put differently configured convex starting from the valve axis 48. This can be achieved by controlled compression of the central valve 24 with the sleeve 68 which helps to implement a secure sealing. By the same token the sleeve 68 can be configured convex in sections at an inner surface of the sleeve 68 that is oriented towards the central valve 24.

Figure 13:
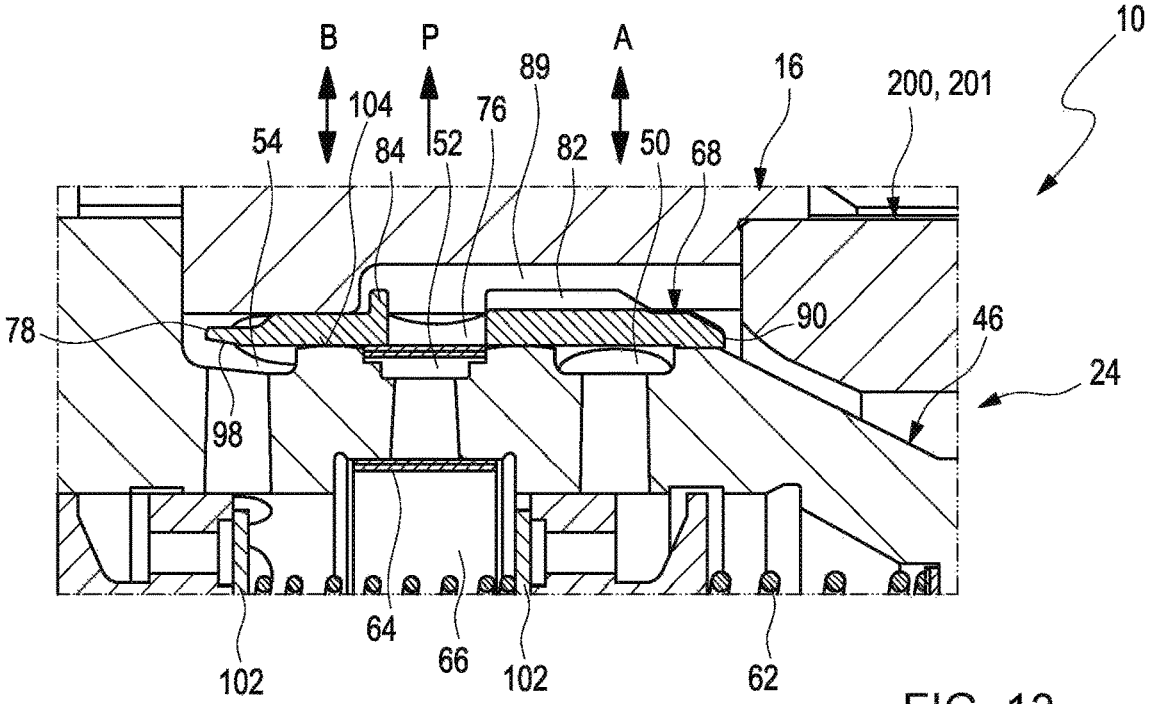
FIG. 13 illustrates a longitudinal sectional view through a second sectional plane in a detail of the cam phaser according to the invention.
Figure 14:
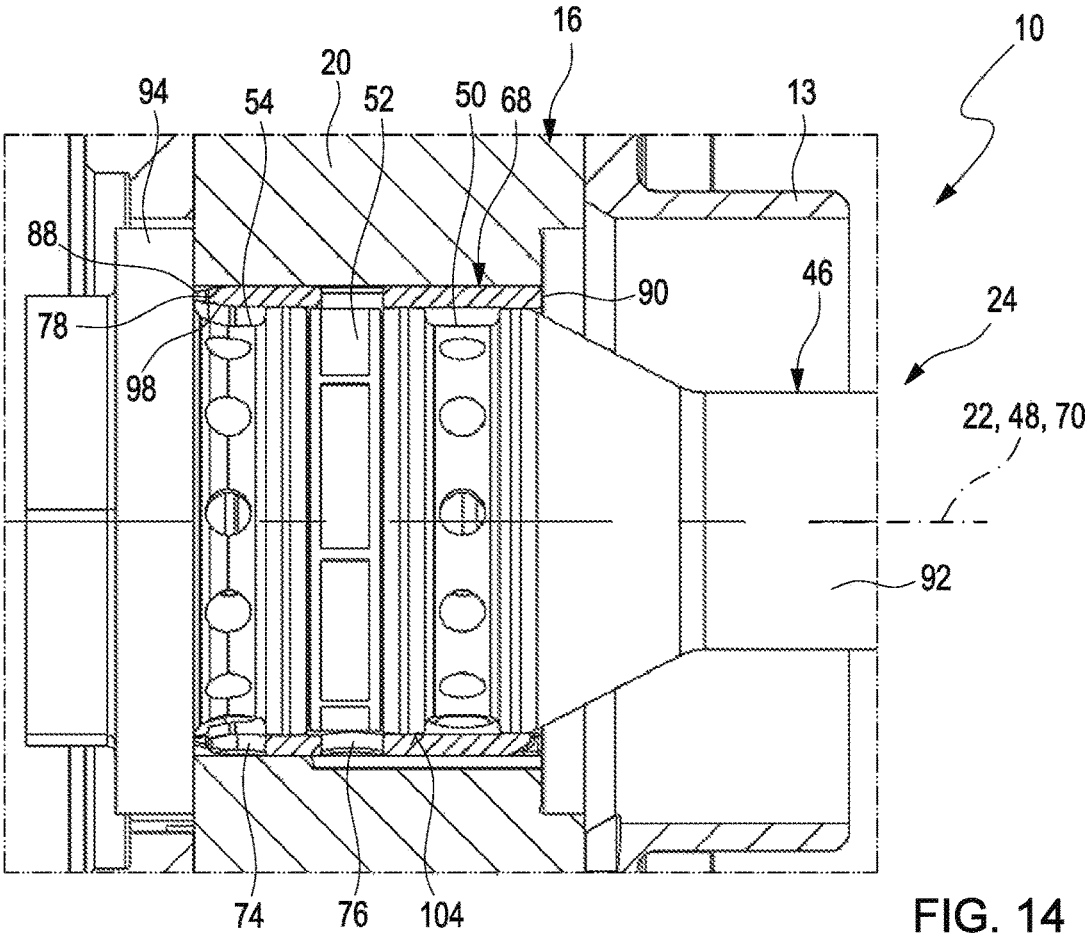
FIG. 14 illustrates a partial sectional view of a detail of the cam phaser with the central valve in a third sectional plane.

It is in particular clearly evident from FIG. 13 that the sleeve 68 facilitates crossing channels without an impact upon the load. This facilitates a connection sequence A-P-B or B-P-A or the radial P-supply of the central valve 24.

The sleeve 68 according to the invention introduced in the instant embodiment is made from a synthetic material by an injection molding process. The sleeve can also be made from metal or from a synthetic material that includes metal.

What is claimed is:

1. A cam phaser, wherein a sleeve is arranged between a central valve and a rotor of the cam phaser, wherein the rotor is rotatable relative to a stator of the cam phaser about a rotation axis of the rotor, wherein a vane of the rotor is arranged positionable between two bars of the stator, wherein the vane divides an intermediary space that is formed between the two bars into a first pressure chamber and a second pressure chamber, wherein the rotor is movable by pressures that are provided in the first pressure chamber and in the second pressure chamber, wherein the central valve is configured to provide pressure loading and pressure relief of the first pressure chamber and the second pressure chamber and includes a first operating connection that is flow connected with the first pressure chamber and a second operating connection that is flow connected with the second pressure chamber and a supply channel configured to supply hydraulic fluid wherein the supply channel is open towards the rotor, wherein the sleeve provides fluid separation of the supply channel and of the first operating connection and of the second operating connection, wherein the sleeve is configured to be flowed through by the hydraulic fluid and so that form locking is formable between the sleeve and the rotor, wherein a first safety element is arranged at an outer enveloping surface of the sleeve and provides secure positioning of the sleeve in the rotor by form locking in a circumferential direction, and wherein a second safety element is arranged at the sleeve and provides form locking in a direction of the rotation axis wherein the sleeve extends in the direction of the rotation axis at least over the first operating connection and the second operating connection.

2. The cam phaser according to claim 1, wherein the first safety element and the second safety element are configured bar shaped and extend towards the rotor from the outer enveloping surface of the sleeve oriented towards the rotor.

3. The cam phaser according to claim 1, wherein the first safety element extends towards the rotation axis.

4. The cam phaser according to claim 1, wherein the second safety element extends in the circumferential direction.

5. The cam phaser according to claim 1, wherein the sleeve is configured to provide a fluid flow through of the first operating connection, the second operating connection and the supply channel.

6. The cam phaser according to claim 1, wherein the sleeve includes first flow through openings, second flow though openings and third flow through openings with different shapes distributed over a circumference of the sleeve, and wherein the first flow through openings are identically shaped and associated with the first operating connection, wherein the second flow through openings are identically shaped and associated with the second operating connection, wherein the third flow through openings are identically shaped and associated with the supply channel.

7. The cam phaser according to claim 6, wherein the third flow through openings that are associated with the supply channel are configured as slotted holes.

8. The cam phaser according claim 6, wherein the third flow through openings that are associated with the supply channel extend substantially in the circumferential direction so that an extension of the third flow through openings in the circumferential direction is greater than an extension of the third flow through openings in the direction of the rotation axis.

9. The cam phaser according to claim 6, wherein the first flow through openings associated with the first operating connection or the second flow through openings associated with the second operating connection are configured circular.

10. The cam phaser according to claim 6, wherein the first flow through openings associated with the first operating connection or the second flow through openings associated with the second operating connection are configured groove shaped.

11. The cam phaser according to claim 1, wherein the sleeve is configured to be oversized relative to an opposite enveloping surface of the central valve before assembly with the central valve.

12. The cam phaser according to claim 1, wherein the sleeve includes at least one bevel that simplifies assembly of the central valve.

13. The cam phaser according to claim 1, wherein the sleeve includes clamping elements that extend in a direction of a valve axis of the central valve and that are configured to provide reliable positioning of the central valve.

14. The cam phaser according to claim 1, wherein the sleeve includes a first interior diameter, a second interior diameter and a third interior diameter that are respectively sized differently, and wherein the first interior diameter, the second interior diameter and the third interior diameter are offset from one another in an axial direction of the sleeve and increase or decrease continuously from one to another in the axial direction of the sleeve.

15. The cam phaser according to claim 14, wherein the first interior diameter, the second interior diameter and the third interior diameter decrease from one to another in an insertion direction of the central valve.

16. The cam phaser according to claim 1, wherein an inner surface of the sleeve that is oriented towards the central valve is configured convex at least in sections.

17. The cam phaser according to claim 1, wherein the sleeve is produced by an injection molding method.

18. The cam phaser according to claim 1, wherein the sleeve is made from a synthetic material.

19. A cam phaser, comprising:

a rotor;

a stator, wherein the rotor is rotatable relative to the stator about a rotation axis of the rotor, wherein a vane of the rotor is arranged positionable between two bars of the stator, wherein the vane divides an intermediary space that is formed between the two bars into a first pressure chamber and a second pressure chamber, wherein the rotor is movable by pressures that are provided in the first pressure chamber and in the second pressure chamber, wherein a central valve is configured to provide pressure loading and pressure relief of the first pressure chamber and the second pressure chamber and includes a first operating connection that is flow connected with the first pressure chamber and a second operating connection that is flow connected with the second pressure chamber and a supply channel configured to supply hydraulic fluid wherein the supply channel is open towards the rotor, wherein a sleeve is arranged between the central valve and the rotor and provides fluid separation of the supply channel and of the first operating connection and of the second operating connection, wherein the sleeve is partially flowable so that the first pressure chamber and the second pressure chamber are supplyable with fluid, and wherein the sleeve is form locked with the rotor and clamped in a radially outward direction against the rotor by the central valve, wherein a first safety element is arranged at an outer enveloping surface of the sleeve and provides secure positioning of the sleeve in the rotor by form locking in a circumferential direction, and wherein a second safety element is arranged at the sleeve and provides form locking in a direction of the rotation axis wherein the sleeve extends in the direction of the rotation axis at least over the first operating connection and the second operating connection.

20. The cam phaser according to claim 19, wherein the sleeve reaches a final clamping configuration in a final insertion position of the central valve.

21. The cam phaser according to claim 19, wherein a sleeve end that is oriented away from an actuator that is associated with the central valve and adjusts the pressure loading and pressure relief is configured to be clamped against the rotor by the central valve.

22. The cam phaser according to claim 19, wherein the central valve is configured convex at a housing enveloping surface of the central valve that is configured opposite to the sleeve.

* * * * *